US009938706B2

(12) United States Patent
Matsunaga

(10) Patent No.: US 9,938,706 B2
(45) Date of Patent: Apr. 10, 2018

(54) FLUSH TOILET

(71) Applicant: PANASONIC INTELLECTUAL PROPERTY MANAGEMENT CO., LTD., Osaka (JP)

(72) Inventor: Hiroshi Matsunaga, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 26 days.

(21) Appl. No.: 15/105,253

(22) PCT Filed: Dec. 16, 2014

(86) PCT No.: PCT/JP2014/006248
§ 371 (c)(1),
(2) Date: Jun. 16, 2016

(87) PCT Pub. No.: WO2015/093040
PCT Pub. Date: Jun. 25, 2015

(65) Prior Publication Data

US 2016/0312457 A1 Oct. 27, 2016

(30) Foreign Application Priority Data

Dec. 19, 2013 (JP) ..... 2013-267709
May 23, 2014 (JP) ..... 2014-107311

(51) Int. Cl.
*E03D 11/08* (2006.01)
*E03D 11/13* (2006.01)
*E03D 9/00* (2006.01)

(52) U.S. Cl.
CPC ..... *E03D 11/08* (2013.01); *E03D 9/00* (2013.01); *E03D 11/13* (2013.01); *E03D 2201/40* (2013.01)

(58) Field of Classification Search
CPC ..... E03D 11/08; E03D 2201/40; E03D 9/00; E03D 11/02; E03D 11/13; E03D 2201/00; E03D 2201/20; E03D 2201/30
(Continued)

(56) References Cited

U.S. PATENT DOCUMENTS

2003/0140406 A1* 7/2003 Miwa ..... E03D 11/02 4/420
2004/0040080 A1* 3/2004 Prokopenko ..... E03D 1/34 4/420
(Continued)

FOREIGN PATENT DOCUMENTS

CN 103015515 4/2013
GB 2 431 937 5/2007
(Continued)

OTHER PUBLICATIONS

Search Report issued in PCT/JP2014/006248, dated Mar. 3, 2015.

*Primary Examiner* — J. Casimer Jacyna
(74) *Attorney, Agent, or Firm* — Greenblum & Bernstein, P.L.C.

(57) ABSTRACT

The flush toilet includes a bowl that includes a drainage outlet portion in a bottom portion and a discharge port in an upper inner surface portion. The flush toilet is configured to wash an inner surface of the bowl by allowing washing water discharged from the discharge port to flow down while swirling along the inner surface of the bowl. The inner surface of the bowl includes a guide passage configured to control flow of the washing water that flows down.

9 Claims, 14 Drawing Sheets

(58) Field of Classification Search
USPC ..... 4/420, 421, 428
See application file for complete search history.

(56) References Cited

U.S. PATENT DOCUMENTS

| | | | | |
|---|---|---|---|---|
| 2007/0000040 | A1* | 1/2007 | Pavek | E03D 11/13 4/420 |
| 2007/0277302 | A1* | 12/2007 | Ichiki | E03D 11/08 4/420 |
| 2013/0047326 | A1* | 2/2013 | Yamasaki | E03D 11/08 4/345 |
| 2014/0109307 | A1* | 4/2014 | Kitaura | E03D 1/085 4/329 |
| 2014/0130246 | A1* | 5/2014 | Wu | E03D 11/02 4/420 |
| 2015/0197928 | A1* | 7/2015 | McHale | E03D 11/02 4/423 |

FOREIGN PATENT DOCUMENTS

| | | |
|---|---|---|
| JP | 2005-098005 | 4/2005 |
| JP | 2010-265693 | 11/2010 |
| JP | 2013-079566 | 5/2013 |

* cited by examiner

FLUSH TOILET

TECHNICAL FIELD

This invention, in general, relates to flush toilets, and specifically relates to a flush toilet in which washing water flows on an inner surface of a bowl while swirling.

BACKGROUND ART

From a viewpoint of saving water and washing of a bowl inner surface, many flush toilets configured such that washing water flows down on the bowl inner surface toward a drainage outlet portion in a bowl bottom portion as a swirling flow, have been provided. Also, although the bowl is, in general, constituted by left and right inner wall surfaces having the same curved surface, a flush toilet in which a valley groove that inclines downward toward the drainage outlet portion is provided closer to one of the left and right side in the vicinity of a bottom portion of the bowl, has also been provided (JP 2013-79566A (hereinafter referred to as "Document 1"), for example). In the flush toilet described in Document 1, washing water that flows down on the bowl inner surface while swirling, smoothly flows into the drainage outlet portion through the valley groove, and therefore, even if the water amount of the washing water is small, a waste transport distance can be extended. However, users desire a flush toilet which is configured such that the water amount of the washing water can be further reduced, and also the bowl inner surface can be washed at lower water pressure.

SUMMARY OF INVENTION

The present invention has been made in view of the above-described problems, and an object of the present invention is to provide a flush toilet in which a bowl inner surface can be washed with a water amount that is smaller than that of a conventional flush toilet, or at lower water pressure than that of a conventional flush toilet.

A flush toilet according to one mode of the present invention includes a bowl. The bowl includes a drainage outlet portion in a bottom portion and a discharge port in an upper inner surface portion. The flush toilet is configured to wash an inner surface of the bowl by allowing washing water discharged from the discharge port to flow down while swirling along the inner surface of the bowl. The bowl includes a guide passage in the inner surface. The guide passage is configured to control the flow of the washing water that flows down along the inner surface of the bowl.

DESCRIPTION OF EMBODIMENTS

Figure 1:
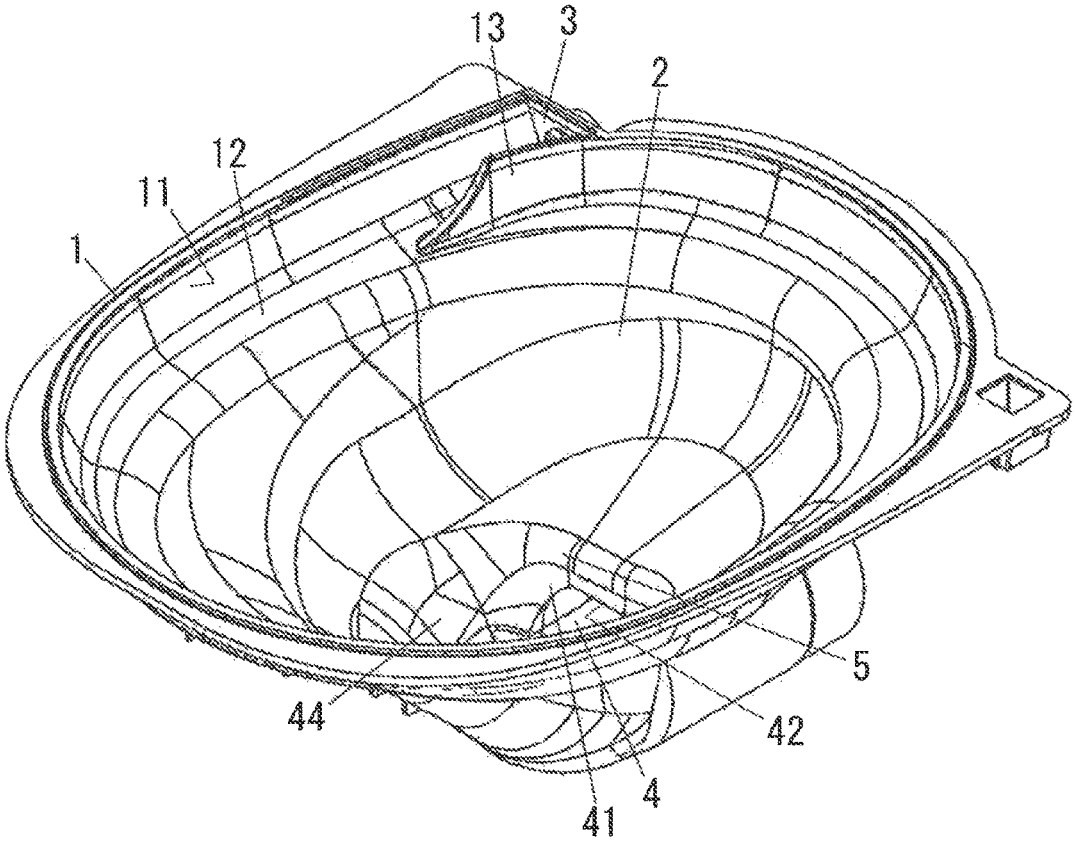
FIG. 1 is a perspective view of a bowl of a present embodiment.

A flush toilet of a present embodiment includes a bowl 1 including a drainage outlet portion 4 in a bottom portion. A discharge port 3 is provided in an upper inner surface portion of the bowl 1. The flush toilet is configured to wash the inner surface of the bowl 1 by allowing washing water discharged from the discharge port 3 to flow down while swirling along the inner surface of the bowl 1. The inner surface of the bowl 1 is provided with a guide passage 2 that controls the flow of the washing water that flows down.

The guide passage 2 is preferably helical in shape and becomes gradually lower toward the drainage outlet portion 4. Also, the guide passage 2 preferably includes a concave surface 4*a* that is concave in a vertical cross section of the bowl 1 (cross-section that is cut along a plane including a vertical direction vector).

Also, a convex surface 5 that is convex in the vertical cross section is preferably continuous to a lower side of the concave surface 4*a* (guide passage 2), and a tangent of the concave surface 4*a* and the convex surface 5 (line in contact with the concave surface 4*a* and the convex surface 5) at an inflection point 7 between the concave surface 4*a* and the convex surface 5 in the vertical cross section of the bowl 1 is preferably inclined downward toward the drainage outlet portion 4.

A tangent of the concave surface 4*a* and the convex surface 5 at an inflection point 7 between the concave surface 4*a* and the convex surface 5 in a vertical cross section of the inner surface of the bowl 1 is preferably (always) inclined downward toward the drainage outlet portion 4 in every vertical cross section of the bowl 1.

Also, the guide passage 2 preferably has a helical shape that is formed so as to reach the drainage outlet portion 4 from an upper portion of the bowl 1 in less than two turns.

Also, a water guide passage 12 surrounded by a peripheral wall 11 is provided in an upper peripheral edge of the bowl 1. The discharge port 3 is configured to discharge the washing water along a circumferential direction of the bowl 1, and supply the washing water inside the bowl 1 via the water guide passage 12. The water guide passage 12 makes a round along the upper peripheral edge of the bowl 1. Also, the water guide passage 12 is slightly inclined such that an inner peripheral side is lower (inclined downward toward an inner peripheral side). The guide passage 2 preferably guides the washing water that has flowed down as a swirling flow from the water guide passage 12 to the drainage outlet portion 4.

The convex surface 5 that is convex in a vertical cross section is continuous to a lower side of the concave surface 4*a* (guide passage 2). A curvature radius R2 of the convex surface 5, on one side of the bowl 1, whose inflection point 7 with the guide passage 2 has a small height, is preferably larger than a curvature radius R1 of the convex surface 5, on another side of the bowl 1, whose inflection point 7 with the concave surface 4*a* has a large height.

That is, the bowl 1 includes the convex surface 5. The convex surface 5 extends from the lower end of the concave surface 4*a* via the inflection point 7, and is convex in the vertical cross section. The bowl 1 is configured to include at least a pair of inflection points 7 (first inflection point 7*a*, second inflection point 7*b*) that are separated in a horizontal direction in the vertical cross section of the bowl 1. The second inflection point 7*b* has a smaller distance (height) from a bottom portion of the bowl 1 in a vertical direction than the first inflection point 7*a*. The curvature radius R2 of the convex surface 5 corresponding to the second inflection point 7*b* is configured to be larger than the curvature radius R1 of the convex surface 5 corresponding to the first inflection point 7*a*.

Also, an inner wall surface on a lower side of the convex surface 5, on the other side of the bowl 1, having the small curvature radius preferably has a larger inclination than an inner wall surface on a lower side of the convex surface 5, on the one side of the bowl 1, having the large curvature radius. Also, a range of the convex surface 5 on the one side of the bowl 1 having the large curvature radius is preferably a range in an approximately half round in a circumferential direction.

That is, the bowl 1 includes a first inner wall surface 43*a* and a second inner wall surface 44*a* in the vertical cross section. The first inner wall surface 43*a* is provided below the convex surface 5 corresponding to the first inflection point 7*a*. The second inner wall surface 44*a* is provided below the convex surface 5 corresponding to the second inflection point 7*b*. The inclination of the first inner wall surface 43*a* is configured so as to be larger than the inclination of the second inner wall surface 44*a*.

Also, the convex surface 5 corresponding to the second inflection point 7*b* is configured to make a half round when the bowl 1 is viewed from above.

Hereinafter, the present embodiment of the present invention will be described in detail. The drawings illustrate the bowl 1 made of synthetic resin in the flush toilet of the present embodiment. The discharge port 3 is provided in a rear portion on one side in an upper edge of the bowl 1. The drainage outlet portion 4 is provided in the bottom portion of the bowl 1. Although the flush toilet is constituted by, the bowl 1 being the main body, a housing covering the periphery, a toilet seat, a toilet cover, a washing water discharge control unit, and the like, only the bowl 1 is illustrated here.

The drainage outlet portion 4 includes a vertical tube portion 41 that extends downward from the bottom portion of the bowl 1 and a cylindrical horizontal tube portion 42 that extends rearward from a lower end of the vertical tube portion 41. The drainage outlet portion 4 is bent in an approximately L shape. The drainage outlet portion 4 is integrally formed with the bottom portion of the bowl 1. Also, the vertical tube portion 41 is provided so as to open at the bottom portion of the bowl 1. An upper end surface of the vertical tube portion 41 has a surface that is smoothly continuous to the inner surface of the bowl 1.

The horizontal tube portion 42 opens rearward. A movable trap tube is connected to a rear end of the horizontal tube portion 42. The trap tube includes a first end that is connected to the horizontal tube portion 42 and a second end on a side opposite to the first end. The second end is a free end. The second end of the trap tube is vertically moved by a motor. When the trap tube is moved up, an opening of the trap tube on the second end is located above an upper end surface inside the horizontal tube portion 42 in the drainage outlet portion 4. In this way, washing water is stored inside the bowl 1. When the second end of the trap tube is moved down, the washing water inside the bowl 1 drains out, and the trap is released. That is, the flush toilet of the present example is a turn trap type flush toilet.

The discharge port 3 supplies the washing water inside the bowl 1 by discharging the washing water along the circumferential direction of the bowl 1. The discharge port 3 of the present embodiment is provided in an upper rear end portion of the bowl 1 on a right side. Also, the peripheral wall 11 is provided in the upper peripheral edge of the bowl 1. The bowl 1 is provided with the water guide passage 12 that is surrounded by the peripheral wall 11. The water guide passage 12 includes a surface 12*a*. The water guide passage 12 makes a round along the upper peripheral edge of the bowl 1 (provided over the whole circumference of the upper edge of the bowl 1). The surface 12*a* of the water guide passage 12 is slightly inclined downward such that an end portion on an inner peripheral side becomes lower. The water guide passage 12 is gradually narrowed in width by a partition wall 13 that partitions the discharge port 3 and the water guide passage 12 in the vicinity of the discharge port 3, and ends.

That is, the water guide passage 12 is provided along the upper peripheral edge of the bowl 1. The water guide passage 12 is shaped to guide washing water discharged from the discharge port 3 along a peripheral edge of the bowl 1. The water guide passage 12 includes the surface 12*a* that is inclined downward toward the bottom portion of the bowl 1. Accordingly, the bowl 1 is configured to allow washing water to flow down toward the bottom portion of the bowl 1 while swirling in the peripheral edge of the bowl 1 along the water guide passage 12.

The washing water that has been strongly discharged from the discharge port 3 flows down toward the bottom portion of the bowl 1 at every position in the circumferential direction as the washing water makes approximately one round along the upper edge of the bowl 1 along the water guide passage 12.

Note that the flush toilet of the present embodiment is configured to supply approximately the same water amount of washing water to the inside of the bowl 1 from every position in the circumferential direction of the water guide passage 12 by appropriately setting the pressure of the washing water that is to be discharged from the discharge port 3, and the angle (angle of the surface 12*a*) of an inclination of the water guide passage 12 that is inclined downward toward the inside of the bowl 1.

The washing water that has flowed down into the bowl 1 from the water guide passage 12 flows down the inner surface of the bowl 1 whose width decreases as it moves downward, as a swirling flow, and reaches the drainage outlet portion 4.

Here, the bowls 1 of conventional flush toilets, including the bowl shown in Document 1 described above, are shaped as a bowl that is formed such that side surfaces on the left and the right have the same curved surface. In the conventional flush toilets, the flow (flow direction) of the washing water when flowing down on the bowl inner surface is formed according to the water pressure and the water amount of the washing water.

In contrast, the bowl 1 of the present embodiment includes the guide passage 2 on the inner surface for controlling the flow direction of the washing water. Specifically, the bowl 1 includes the helical guide passage 2 that is spiral in plan view (when viewed from the above). The guide passage 2 controls the flow direction of the washing water with its inclination. The guide passage 2 of the present embodiment is constituted by the concave surface 4*a* that is concave in a vertical cross section. Also, the guide passage 2 (that is, the concave surface 4*a*) is helical in shape and becomes gradually lower toward the drainage outlet portion 4, and therefore left and right surfaces of the bowl 1 are asymmetrical.

Note that the guide passage 2 does not flush down washing water by guiding all water currents only along the guide passage 2. As described later, water currents that leave the guide passage 2 and flow down are allowed to occur. Also, depending on the water amount and the water pressure, water currents in which some washing water splashes out outward from the guide passage 2 in a curve in the circumferential direction of the bowl 1 and returns again to the guide passage 2 are allowed to occur. The water currents are regarded as being controlled by the guide passage 2 if the washing water as a whole flows down for the most part along the guide passage 2 and most of the washing water reaches the drainage outlet portion 4 while making the number of swirls that is defined by the helical guide passage 2, even if some of the washing water that flows down inside the bowl 1 leaves the guide passage 2.

Figure 7:
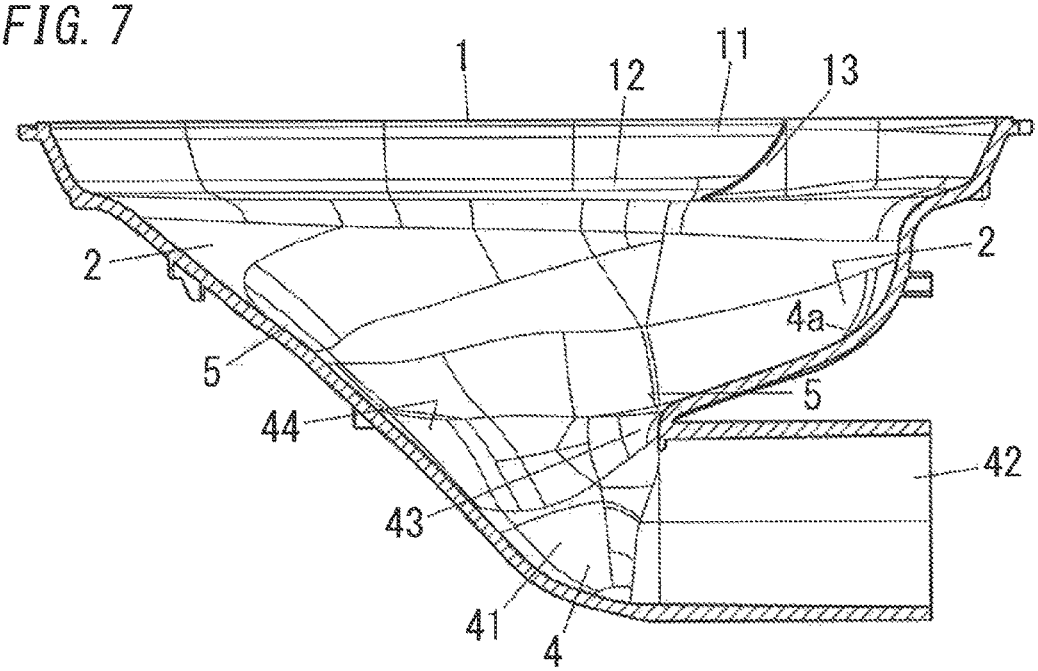
FIG. 7 is a cross-section taken along line E-E in FIG. 2.
Figure 8:
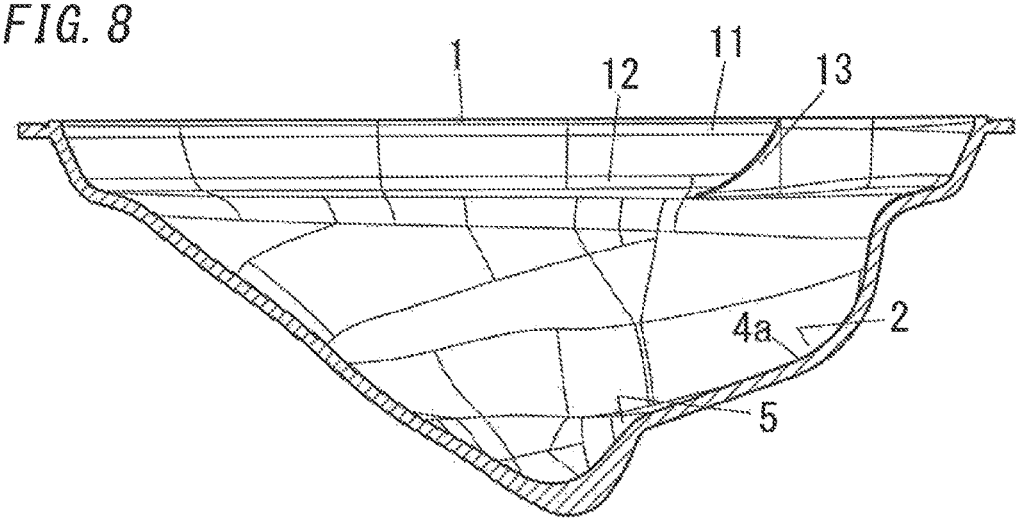
FIG. 8 is a cross-section taken along line F-F in FIG. 2.
Figure 9:
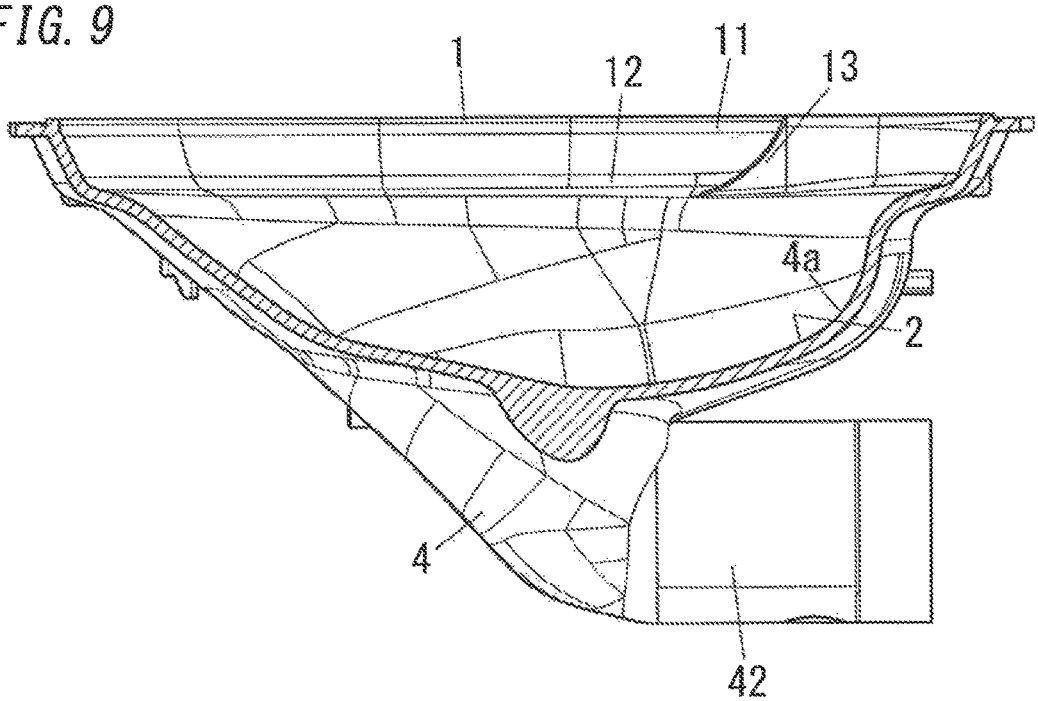
FIG. 9 is a cross-section taken along line G-G in FIG. 2.
Figure 10:
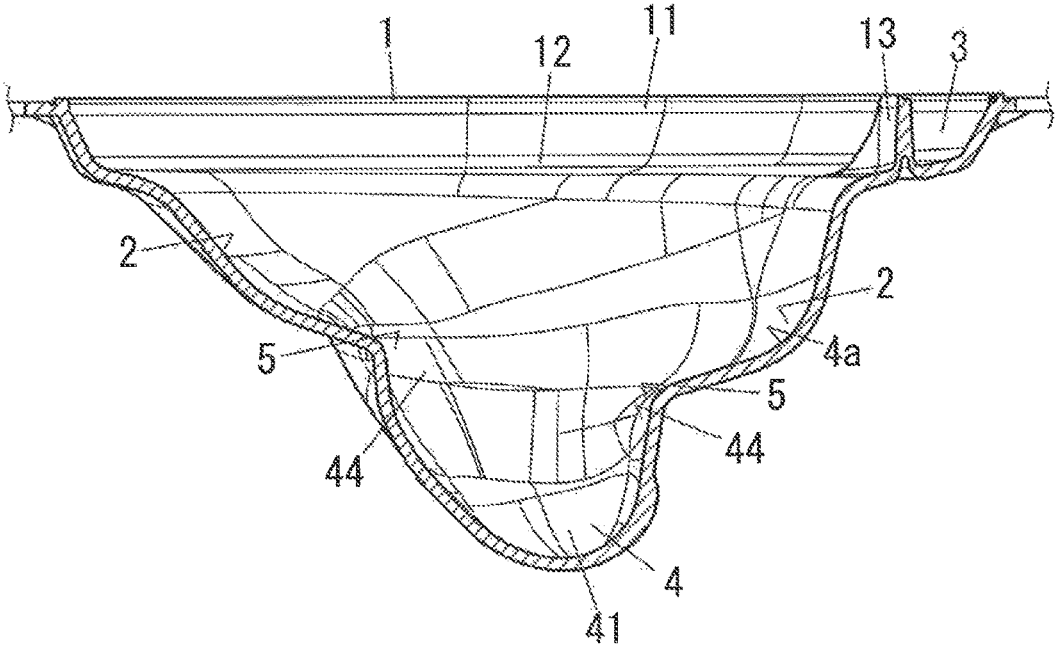
FIG. 10 is a cross-section taken along line H-H in FIG. 2.
Figure 11:
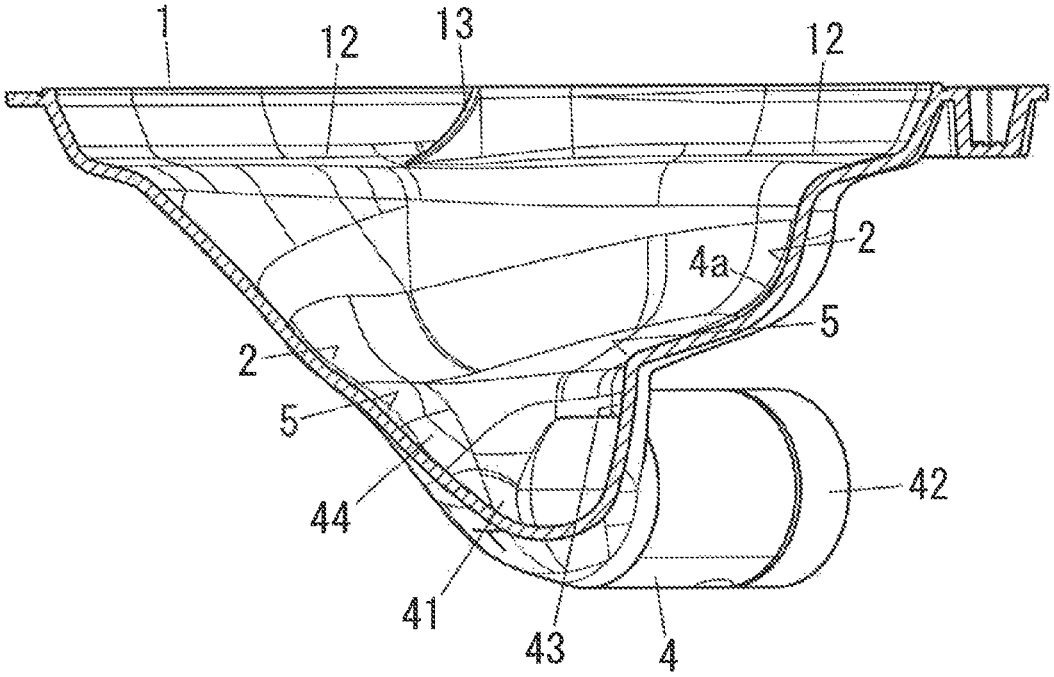
FIG. 11 is a cross-section taken along line I-I in FIG. 2.

The convex surface 5 that is convex in a vertical cross section is continuous downward to a lower edge of the helical guide passage 2 that runs toward the drainage outlet portion 4. The guide passage 2 is connected to the vertical tube portion 41 of the drainage outlet portion 4 via the convex surface 5. Note that, because the guide passage 2 makes a round or more along the inner surface of the bowl 1, a portion of the guide passage 2 is connected again, on a lower edge side thereof, to another portion of the guide passage 2 via the convex surface 5, as shown in FIG. 7.

Note that thin lines added to the inner surface (and outer surface) of the bowl 1 in the drawings designate boundary curves when a free curved surface is represented by a set of plurality of curved surfaces (patches), for example, by NURBS (Non-Uniform Rational B-spline) in a three-dimensional CAD. The boundary curves include lines that connect inflection points 7, between the guide passage 2 (concave surface 4*a*) that is concave in the vertical cross section and the convex surface 5 that is located below the guide passage 2, in the circumferential direction of the bowl 1. From the illustrated boundary curves, it can be understood that the inner surface of the bowl 1 is, as a whole, asymmetrical in the horizontal direction, and the guide passage 2 is helical.

Figure 4:
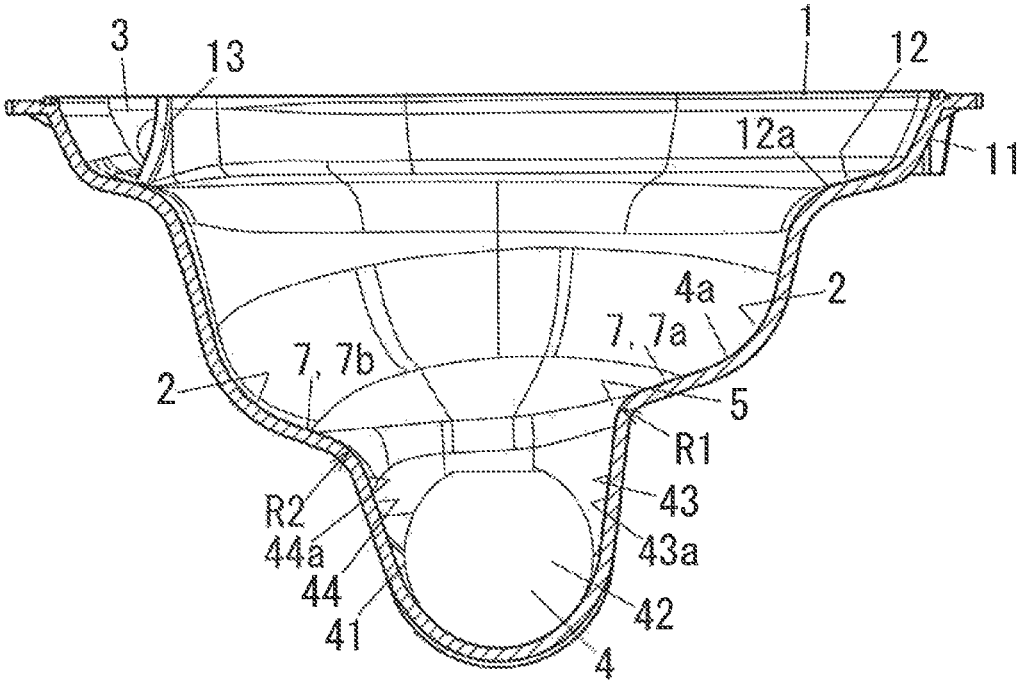
FIG. 4 is a cross-section taken along line B-B in FIG. 2.
Figure 15:
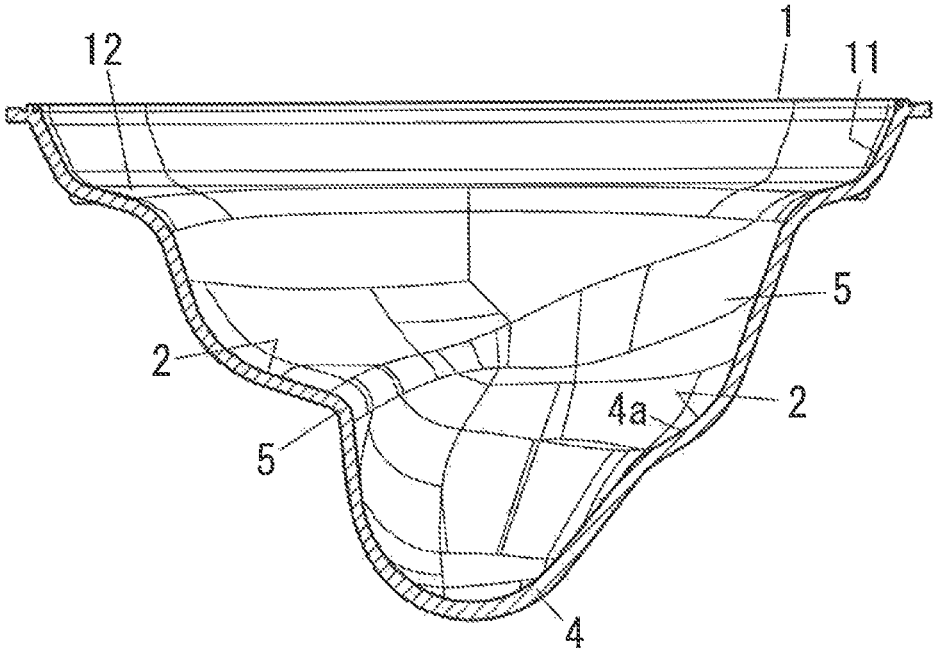
FIG. 15 is a cross-section taken along line L-L in FIG. 12.
Figure 16:
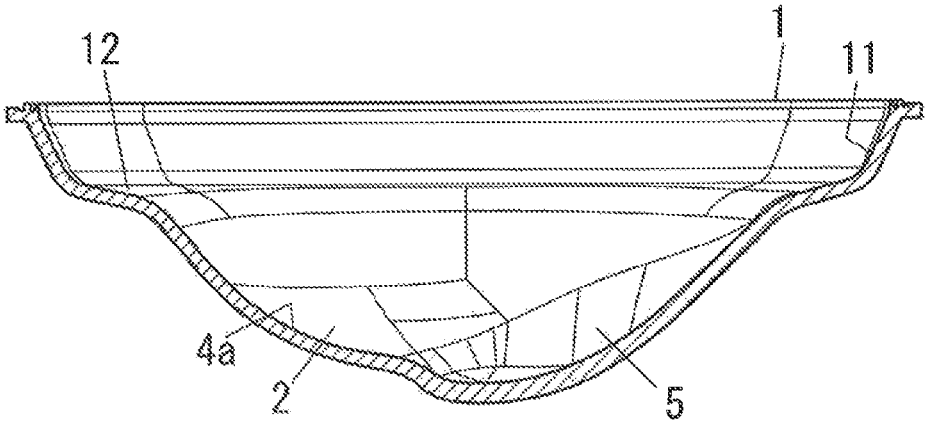
FIG. 16 is a cross-section taken along line M-M in FIG. 12.
Figure 17:
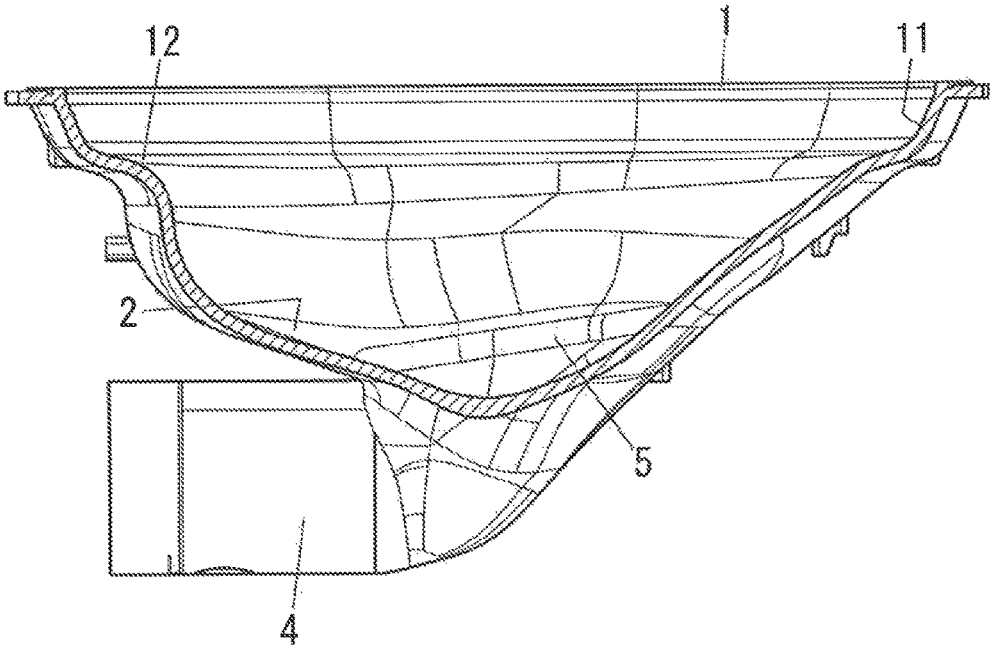
FIG. 17 is a cross-section taken along line N-N in FIG. 12.
Figure 18:
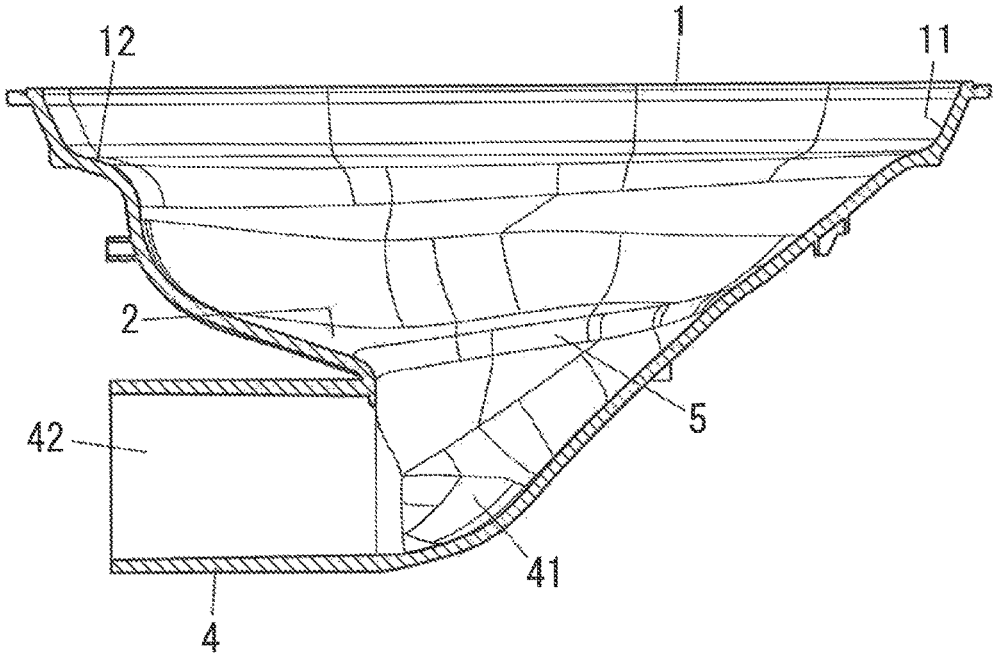
FIG. 18 is a cross-section taken along line O-O in FIG. 12.
Figure 19:
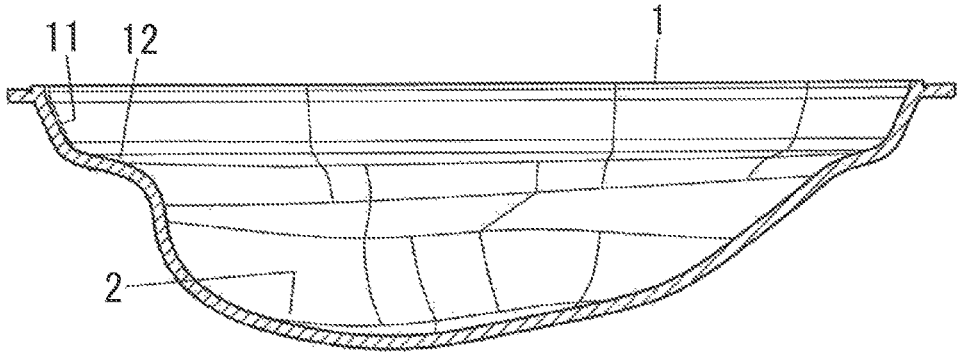
FIG. 19 is a cross-section taken along line P-P in FIG. 12.
Figure 20:
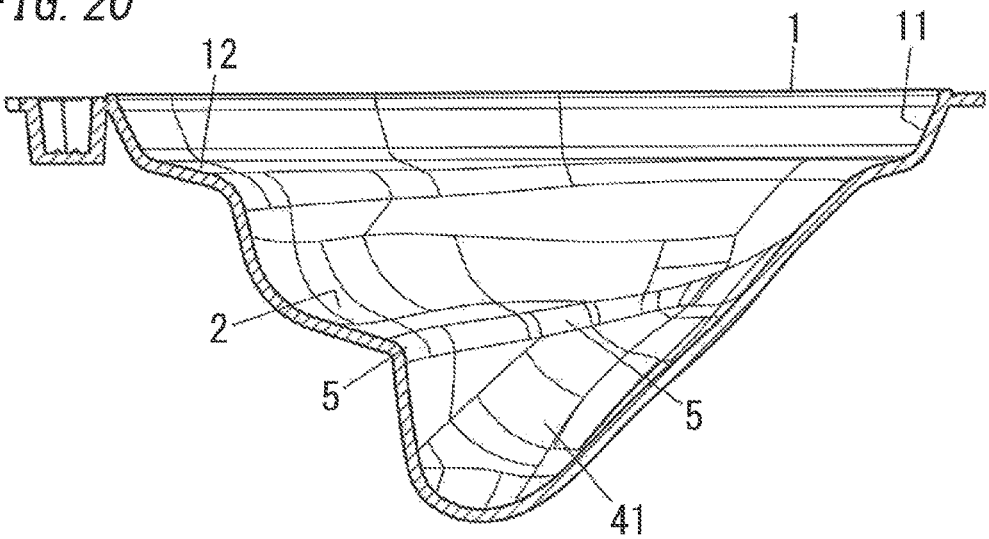
FIG. 20 is a cross-section taken along line Q-Q in FIG. 12.
Figure 21:
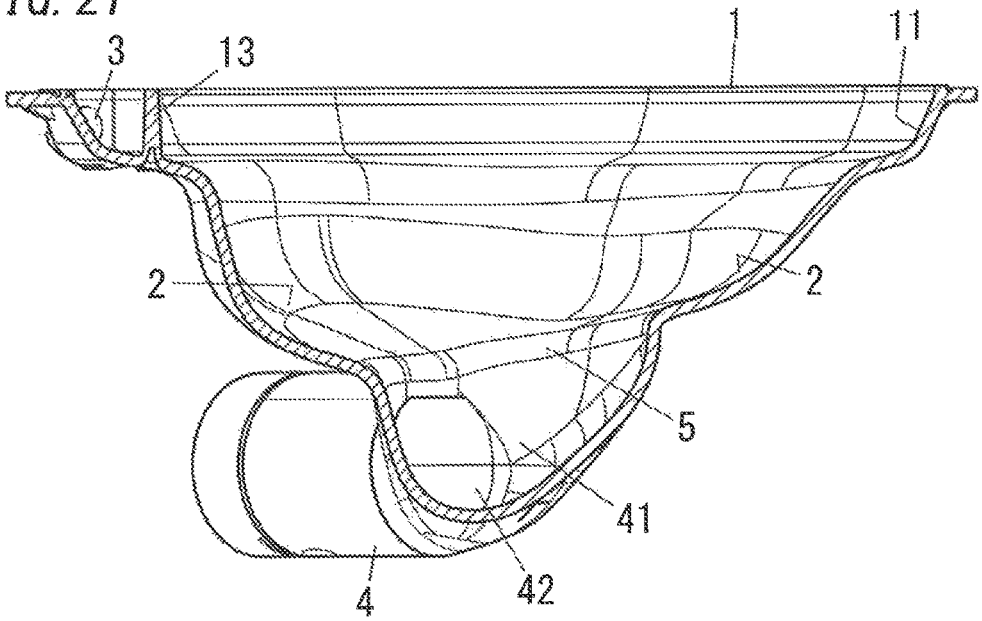
FIG. 21 is a cross-section taken along line R-R in FIG. 12.

Note that the guide passage 2 includes a portion that makes it difficult to understand that the guide passage 2 is helical, because, in addition to the curvature of the concave surface 4*a* not being constant, the curvature changes midway in the circumferential direction when viewed from above the bowl 1, and the guide passage 2 is a combination of the plurality of concave surfaces 4*a* that have different curvatures. However, the boundary curve in a portion of the convex surface 5 that is located below the guide passage 2 is clearly helical, as shown in FIGS. 15 and 4, for example. This is evidence that the guide passage 2 above the convex surface 5 is helical.

Figure 12:
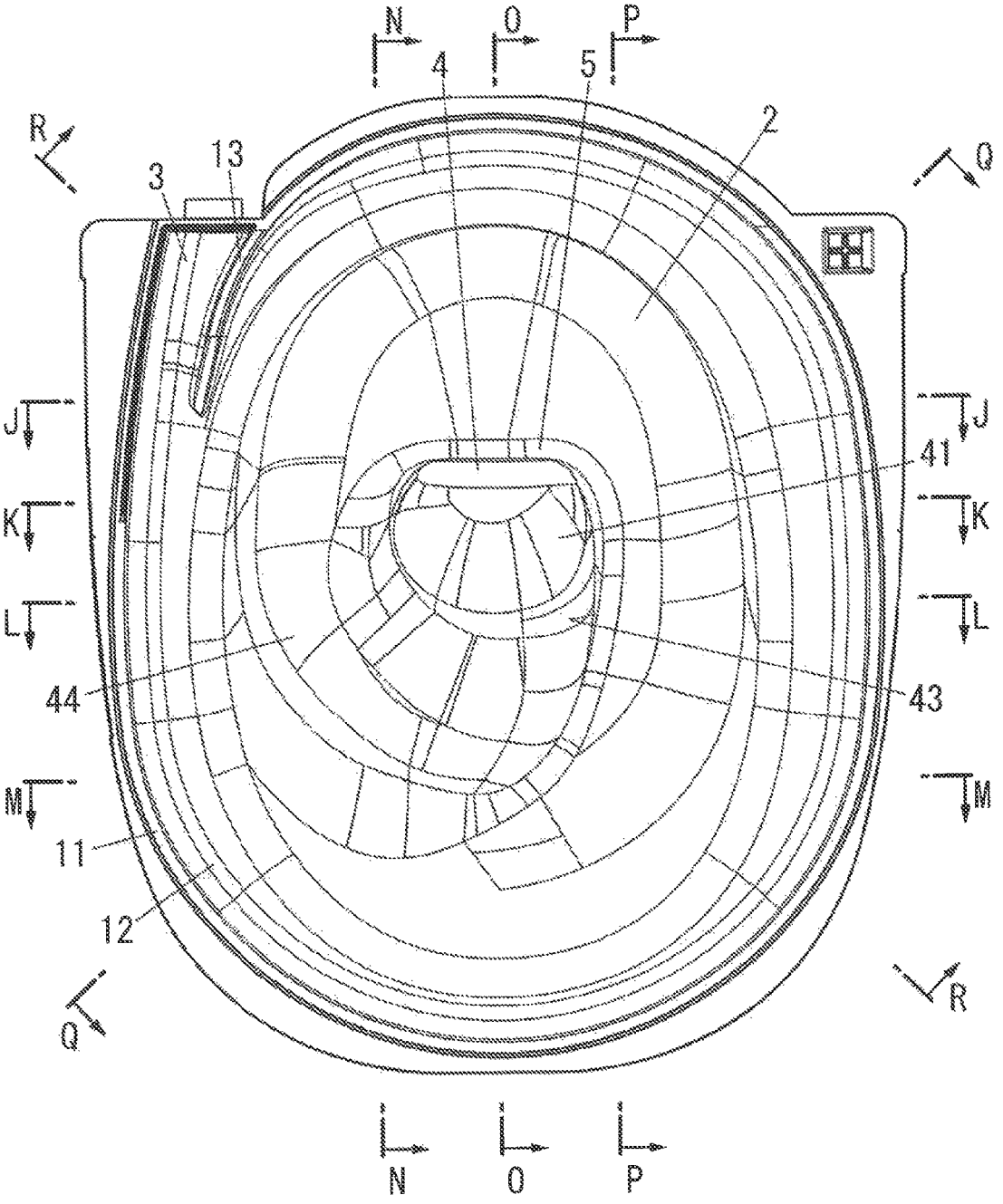
FIG. 12 is a plan view of the bowl of the present embodiment.
Figure 13:
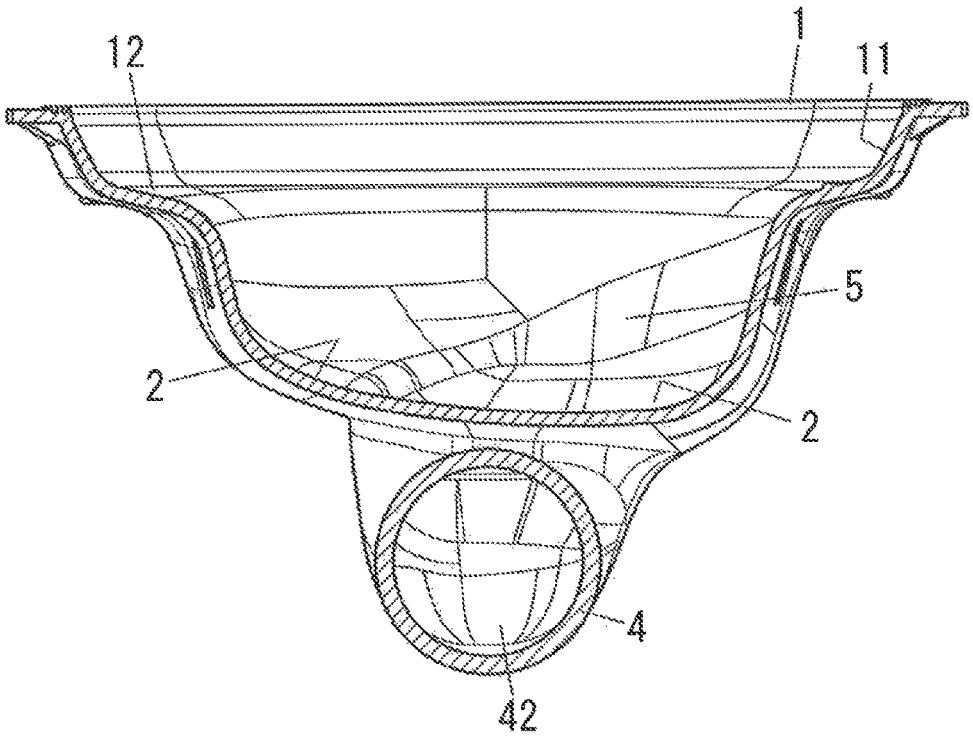
FIG. 13 is a cross-section taken along line J-J in FIG. 12.
Figure 14:
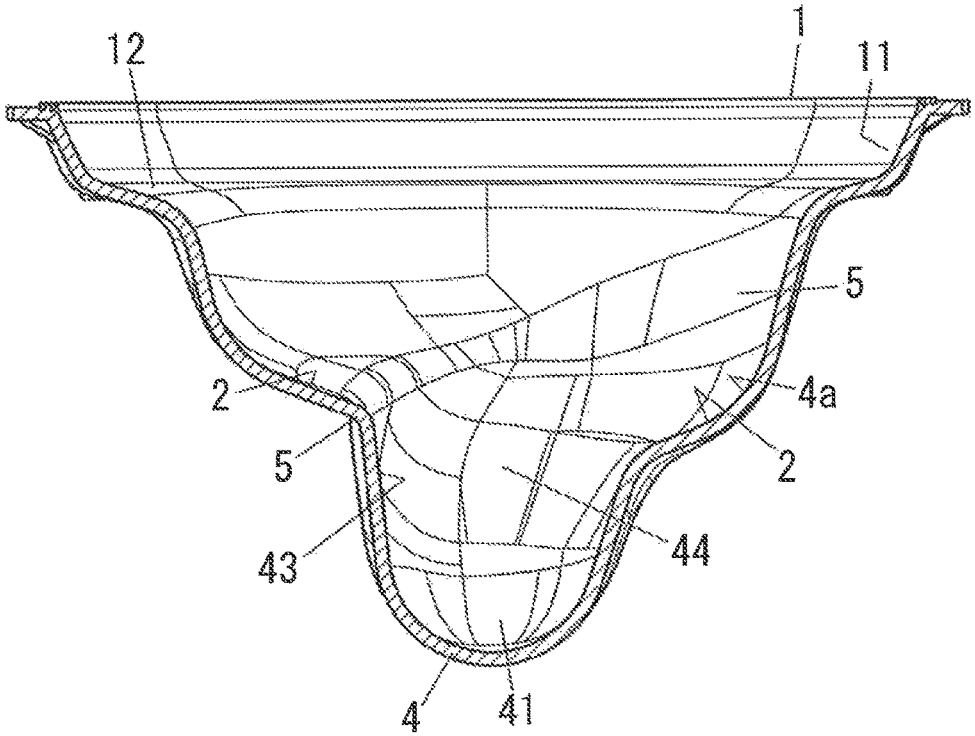
FIG. 14 is a cross-section taken along line K-K in FIG. 12.
Figure 22:
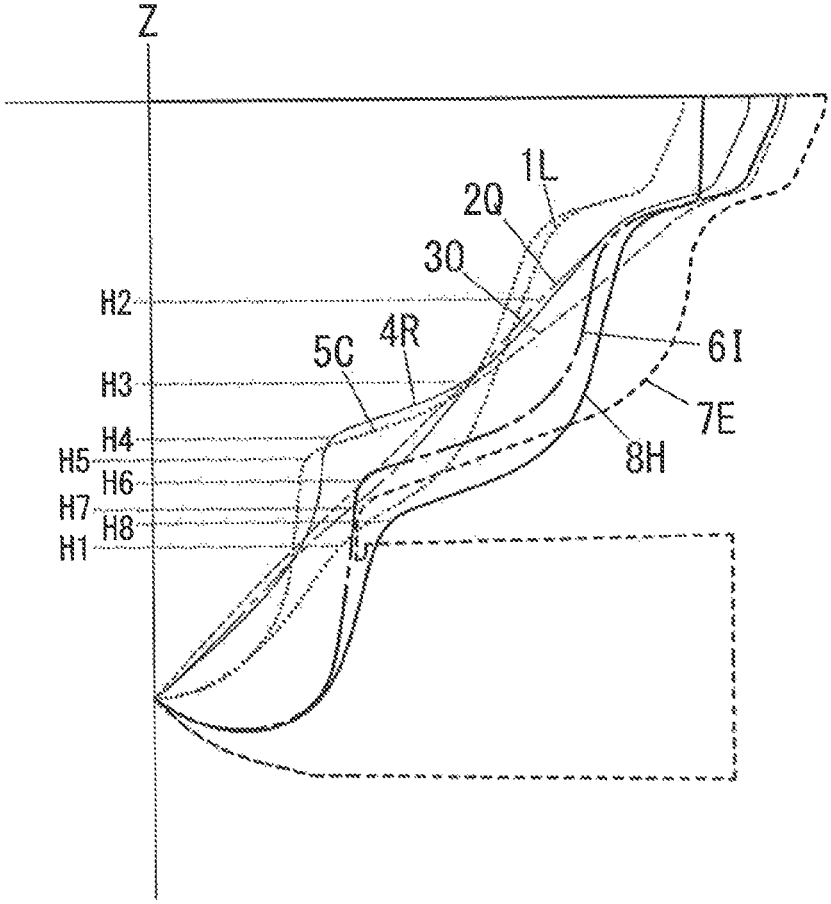
FIG. 22 is a descriptive diagram in which a plurality of cross-sections of an inner surface of the bowl of the present embodiment are superimposed.

Also, FIG. 22 shows right half portions of a cross-section taken along line C-C (FIG. 2), a cross-section taken along line E-E (FIG. 2), a cross-section taken along line H-H (FIG. 2), a cross-section taken along line I-I (FIG. 2), a cross-section taken along line L-L (FIG. 12), a cross-section taken along line O-O (FIG. 12), a cross-section taken along line R-R (FIG. 12), and a cross-section taken along line Q-Q (FIG. 12) in a superimposed manner. A reference sign Z in FIG. 22 is an intersection of the above cross-sectional lines.

Washing water that has been discharged from the discharge port 3 passes through the water guide passage 12 on the cross-section taken along line L-L (1L in FIG. 22), and starts to flow down to the guide passage 2 in the vicinity of the cross-section taken along line Q-Q (2Q in FIG. 22) and the cross-section taken along line O-O (3O in FIG. 22). Then the washing water flows through the guide passage 2 in the cross-section taken along line R-R (4R in FIG. 22), the cross-section taken along line C-C (5C in FIG. 22), and furthermore the cross-section taken along line I-I (6I in FIG. 22) while increasing speed. Then the washing water flows down from a later-described gentle slope 44 to the drainage outlet portion 4 via the guide passage 2 in the cross-section taken along line E-E (7E in FIG. 22) and the cross-section taken along line H-H (8H in FIG. 22).

In FIG. 22, height positions of the convex surface 5 below the guide passage 2 in the respective cross-sections 1L, 2Q, 3O, 4R, 5C, 6I, 7E, and 8H are indicated by H1, H2, H3, H4, H5, H6, H7, and H8. The height position on the lower edge side of the guide passage 2 becomes gradually lower in an order of 2Q-3O-4R-5C-6I-7E-8H-1L. From this, it can be understood that the guide passage 2 is helical.

Figure 5:
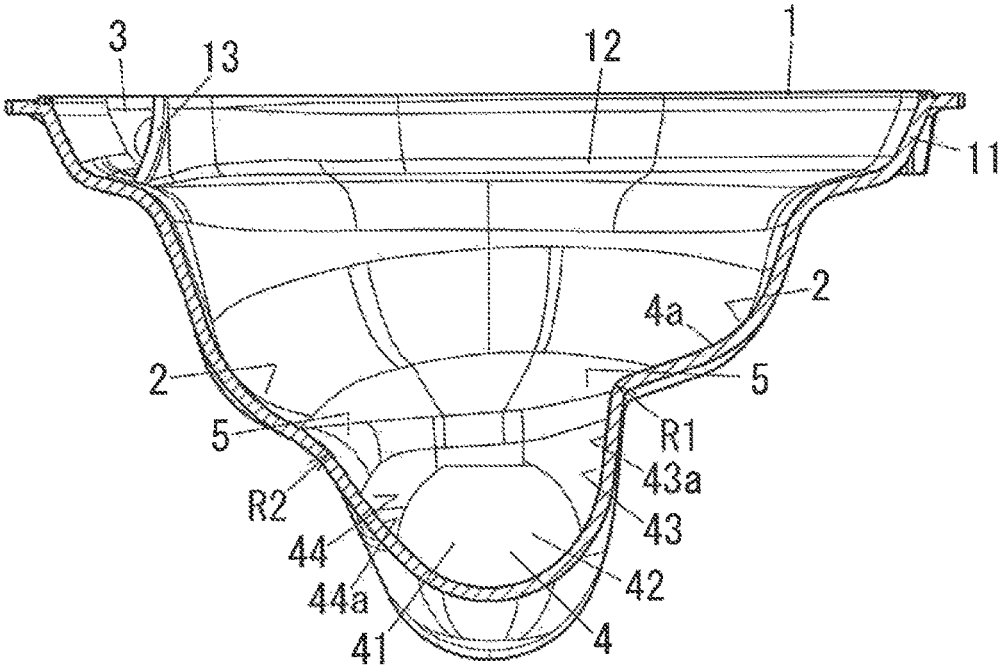
FIG. 5 is a cross-section taken along line C-C in FIG. 2.
Figure 6:
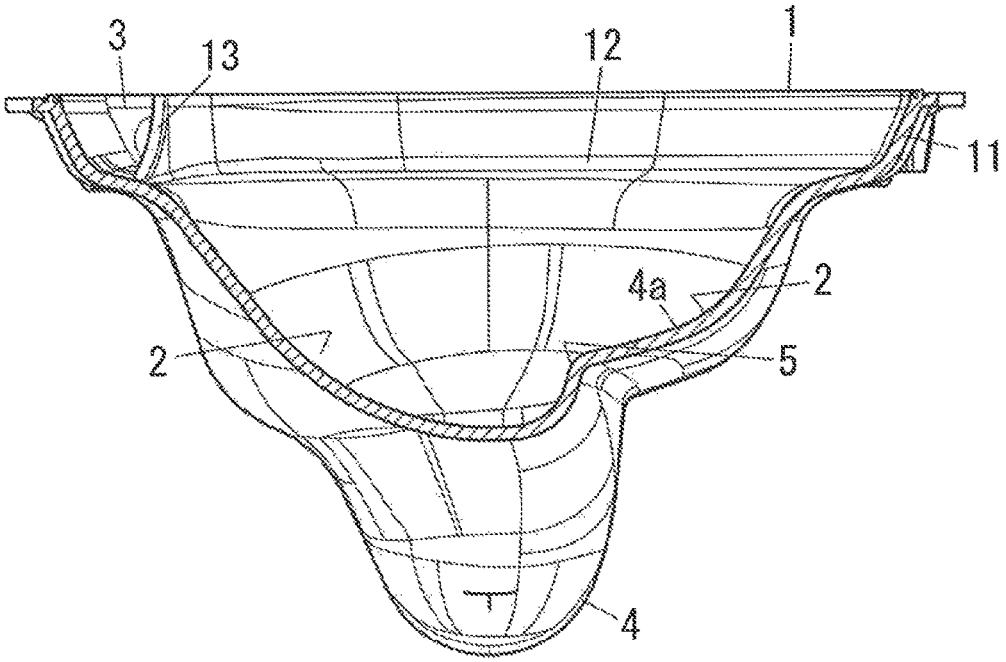
FIG. 6 is a cross-section taken along line D-D in FIG. 2.

Also, the curvature radius R2 of the convex surface 5, on the one side of the bowl 1 (right side of the bowl 1 in FIGS. 4 and 5), whose inflection point 7 with the guide passage 2 is at a low position is larger than the curvature radius R1 of the convex surface 5, on the other side of the bowl 1 (left side of the bowl 1 in FIGS. 4 and 5), whose inflection point 7 with the guide passage 2 is at a high position.

That is, the inflection points 7 between the guide passage 2 and the convex surface 5 in the vertical cross section of the bowl 1 appear as being separate in the horizontal direction. This at least a pair of inflection points 7 includes the first inflection point 7*a* and the second inflection point 7*b*. The distance (height) in the vertical direction from the bottom portion of the bowl 1 to the second inflection point 7*b* is shorter (lower) than the distance (height) from the bottom portion of the bowl 1 to the first inflection point 7*a* in the vertical direction. Also, the curvature radius R2 of the convex surface 5 corresponding to the second inflection point 7*b* is configured to be larger than the curvature radius R1 of the convex surface 5 corresponding to the first inflection point 7*a*.

Furthermore, a portion of the vertical tube portion 41 whose upper portion is continuous to the convex surface 5 having the small curvature radius R1 forms a steep wall 43, meanwhile, a portion of the vertical tube portion 41 whose upper portion is continuous to the convex surface 5 having the large curvature radius R2 is constituted by the gentle slope 44.

That is, the bowl 1 includes the steep wall 43 provided below the convex surface 5 corresponding to the first inflection point 7*a*. An inner surface of the steep wall 43 is the first inner wall surface 43*a*. Also, the bowl 1 includes the gentle slope 44 provided below the convex surface 5 corresponding to the second inflection point 7*b*. This gentle slope 44 is the second inner wall surface 44*a*. The inclination of the first inner wall surface 43*a* is larger than the inclination of the second inner wall surface 44*a*.

Note that the steep wall 43 also exists in the vertical tube portion 41 that is located between the convex surface 5 on the rear side of the bowl 1 and the horizontal tube portion 42 that opens below the convex surface 5. Also, the gentle slope 44 also exists in a front surface of the vertical tube portion 41 that is continuous to a lower end of the convex surface 5 on the front side of the bowl 1. Reference sign 6 in FIG. 2 indicates a range of the gentle slope 44, which is provided in a range that makes approximately a half round in the circumferential direction of the bowl 1 from the right side to the front portion thereof.

Also, the convex surface 5 having the large curvature radius R2 is continuous to the gentle slope 44 on an inner side of an end portion on the inner peripheral side of the helical guide passage 2, and the steep wall 43 having a large inclination is provided forward of the end portion on the inner peripheral side of the guide passage 2.

When washing water is discharged from the discharge port 3 to the inside of the bowl 1, the washing water flows down inside the bowl 1 while swirling as the washing water makes approximately one round along the water guide passage 12, and the washing water further swirls by being guided by the guide passage 2, as described above. Also, while the washing water flows down as a swirling flow for the most part along the helical guide passage 2, a portion of the washing water flows down from the guide passage 2 to the drainage outlet portion 4 via the convex surface 5 that is located below the guide passage 2. However, most of the washing water swirls along the guide passage 2, and smoothly flows into the horizontal tube portion 42 of the drainage outlet portion 4 via the gentle slope 44 that is located ahead of the steep wall 43.

Figure 2:
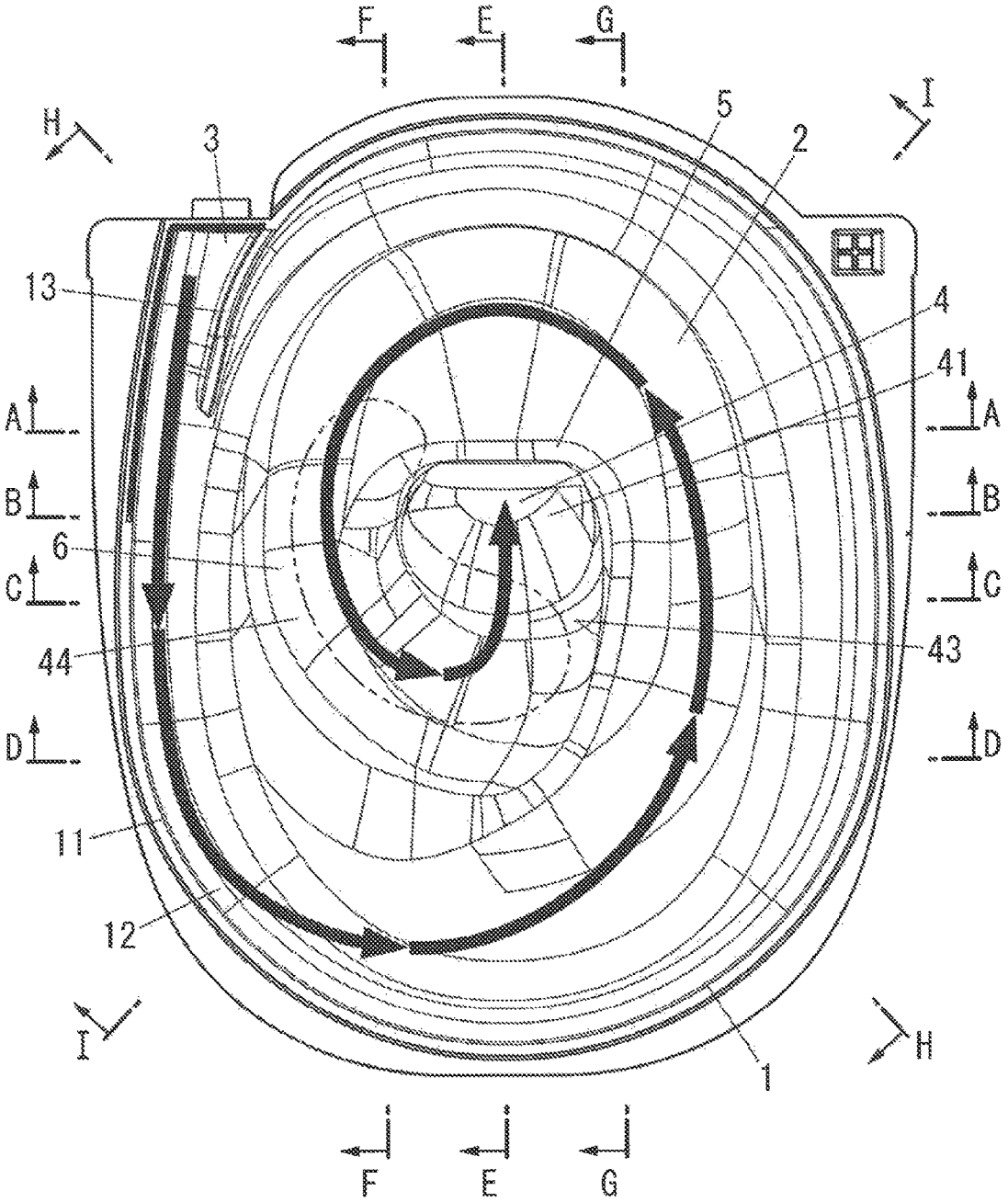
FIG. 2 is a plan view of the bowl of the present embodiment.
Figure 3:
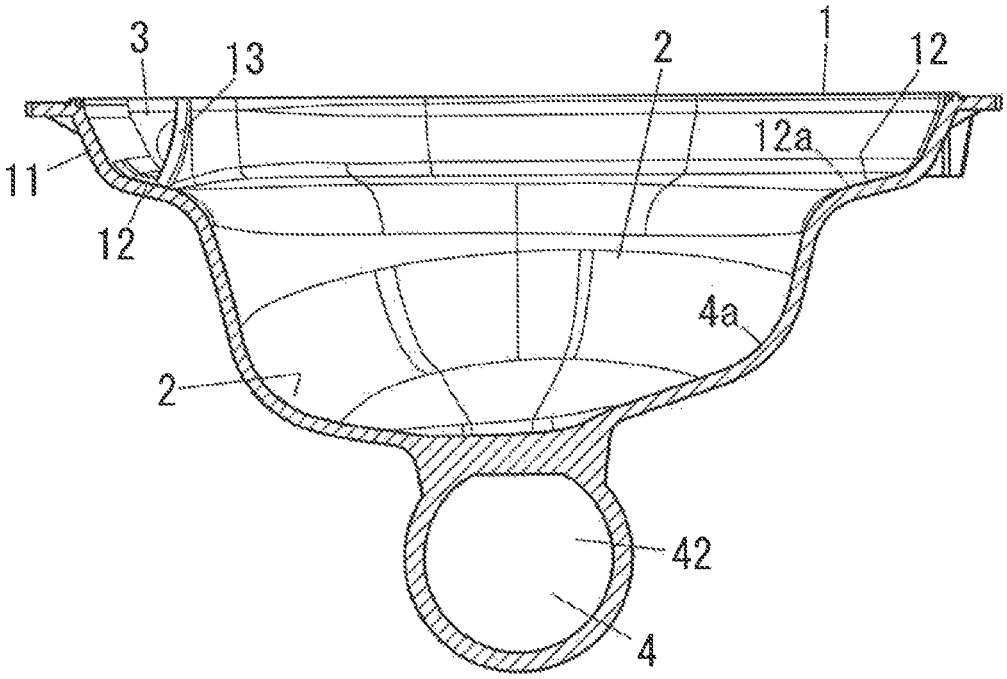
FIG. 3 is a cross-section taken along line A-A in FIG. 2.
Figure 23:
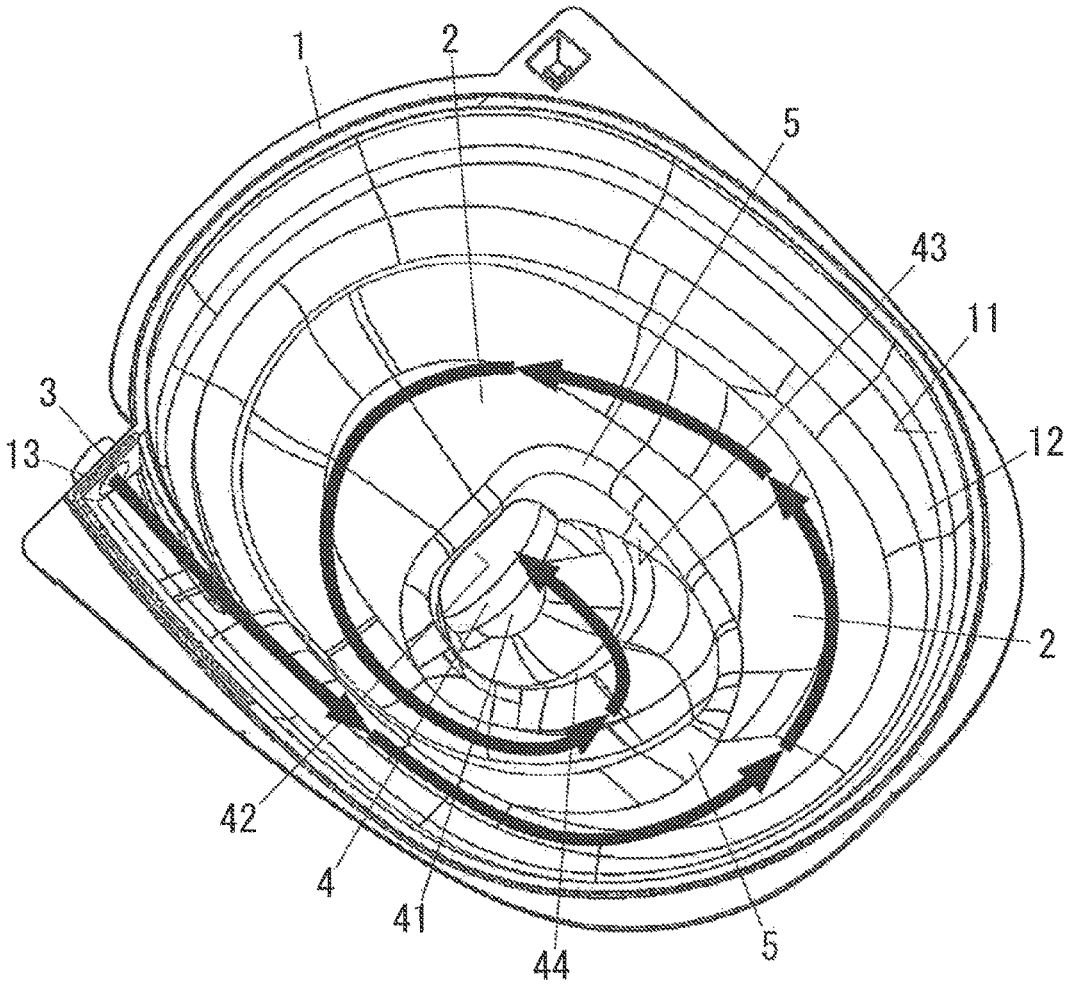
FIG. 23 is a perspective view of the bowl of the present embodiment.

Accordingly, the washing water that is discharged from the discharge port 3 and flows down while swirling reaches the drainage outlet portion 4 before making two rounds inside the bowl 1 (approximately one and half rounds in the illustrated example) as indicated by arrows in FIGS. 2 and 23. In conventional flush toilets in which washing water flows as a swirling flow, the washing water reaches the drainage outlet portion 4 after swirling two or more rounds inside the bowl 1. Therefore, in the bowl 1 of the present embodiment, the washing water can be sent to the drainage outlet portion 4 more strongly than in the conventional flush toilet.

Also, in the flush toilet of the present embodiment, instead of the water current flowing uniformly inside the bowl 1, most of the washing water flows along the guide passage 2. Also, this current strongly and smoothly flows into the horizontal tube portion 42 via the gentle slope 44 that is continuous to a front opening of the horizontal tube portion 42 of the drainage outlet portion 4. Accordingly, in the flush toilet of the present embodiment, the waste transport distance can be extended even if the amount of the washing water is small and the discharge pressure of the washing water is low.

Also, in the bowl 1 of the present embodiment, the positions of the inflection points 7 between the guide passage 2 and the convex surface 5 on the left and right are at different heights, and thus, the convex surface 5 has different curvature radiuses R1 and R2 on the left and right, as described above. The amount of water that flows along the guide passage 2 as a swirling flow is large in the guide passage 2 whose inflection point 7 with the convex surface 5 is high (the amount of water that flows down to the drainage outlet portion 4 via the convex surface 5 having the small curvature radius R1 is small), and most of the washing water reaches the drainage outlet portion 4 via the gentle slope 44.

In the conventional bowl in which left and right side walls are formed with the same curved surface, the washing water that flows down to the drainage outlet portion 4 from the left and the washing water that flows down to the drainage outlet portion 4 from the right collide in front of the horizontal tube portion 42, and the flow to the horizontal tube portion 42 is hampered, in contrast, in the bowl 1 of the present embodiment, such a phenomenon is unlikely to occur. Accordingly, the washing water can be smoothly drained out.

Note that the tangent of the guide passage 2 in the vertical cross section and the tangent at the inflection point 7 between the guide passage 2 and the convex surface 5 below the guide passage 2 (the tangent of the concave surface 4*a* and the convex surface 5 at the inflection point 7 in the vertical cross section) are inclined downward toward the drainage outlet portion 4. Also, in the flush toilet of the present embodiment, the tangent of the inner surface of the bowl 1 in the vertical cross section is always (in every vertical cross section) inclined downward toward the drainage outlet portion 4. Therefore, although the helical guide passage 2 is provided, instead of all the washing water flowing as a swirling flow along the guide passage 2, water currents that flow down from the guide passage 2 toward the inner peripheral side thereof occur. Accordingly, the washing water not only drains out the waste inside the bowl 1, in the case where detergent for washing the inner surface of the bowl 1 is added to the washing water, the inner surface of the bowl 1 is thoroughly washed.

Releasing the trap by driving the aforementioned trap tube is performed at a point in time after the elapsing of an appropriate time from when the discharge of washing water started, and the trap tube is caused to return so as to form a water seal surface before the discharging of the washing water ends.

The helical guide passage 2 does not need to be the concave surface 4*a* in the vertical cross section along the entire length thereof, and may have a portion that is flat or convex in the vertical cross section. In the illustrated example as well, a portion that is an inclined flat surface exists on a lower edge side of a portion that is the concave surface 4*a* in the vertical cross section.

Although a turn trap type was shown in the above example, the present invention is not limited thereto, but may be applied to other drainage types.

Also, although water into which detergent is added can be preferably used as the washing water, water without detergent may be used.

The invention claimed is:

1. A flush toilet, comprising a bowl including a drainage outlet portion in a bottom portion and a discharge port in an upper inner surface portion, the flush toilet being configured to wash an inner surface of the bowl by allowing washing water discharged from the discharge port to flow down while swirling along the inner surface of the bowl, wherein the inner surface of the bowl comprises a guide passage configured to control flow of the washing water that flows down along the inner surface of the bowl, the guide passage comprises a concave surface that is concave in at least one vertical cross section of the bowl, the guide passage is helical in shape and becomes gradually lower toward the drainage outlet portion from an upper portion of the bowl, and in the at least one vertical cross section of the bowl, every inclined tangent on the inner surface in the at least one vertical cross section goes downward toward a drainage outlet portion side.

2. The flush toilet according to claim 1, wherein a convex curved surface that is convex in the at least one vertical cross section is continuous to a lower side of the concave surface, and a tangent at an inflection point between the concave surface and the convex curved surface is inclined downward toward the drainage outlet portion in the at least one vertical cross section of the bowl.

3. The flush toilet according to claim 1, wherein the every inclined tangent on the inner surface of the bowl goes downward toward the drainage outlet portion side in every vertical cross section of the inner surface of the bowl.

4. The flush toilet according to claim 1, wherein the guide passage has a helical shape that reaches the drainage outlet portion in a bottom portion of the bowl from the upper portion of the bowl in two or less turns.

5. The flush toilet according to claim 1, wherein the bowl includes a water guide passage surrounded by a peripheral wall in an upper peripheral edge, and the discharge port is configured to discharge the washing water along a circumferential direction of the bowl, and supply the washing water inside the bowl via the water guide passage, the water guide passage makes a round along the upper peripheral edge of the bowl, and is inclined downward toward an inner peripheral side, and the guide passage is for guiding washing water that flows down as a swirling flow from the water guide passage to the drainage outlet portion.

6. The flush toilet according to claim 1, wherein a convex curved surface that is convex in the at least one vertical cross section is continuous to a lower side of the concave surface, and a curvature radius of the convex curved surface, on one side of the bowl, whose inflection point with the concave surface has a small height from the bottom portion of the bowl is larger than a curvature radius of the convex curved surface, on another side of the bowl, whose inflection point with the concave surface has a large height from the bottom portion of the bowl.

7. The flush toilet according to claim 6, wherein an inner wall surface on a lower side of the convex curved surface on the other side of the bowl having the small curvature radius has a larger inclination than an inner wall surface on a lower side of the convex curved surface on the one side of the bowl having the large curvature radius.

8. The flush toilet according to claim 6, wherein a range of the convex curved surface on the one side of the bowl having the large curvature radius is a range in an approximately half round in a circumferential direction.

9. The flush toilet according to claim 2, wherein the guide passage has a helical shape that reaches the drainage outlet portion in a bottom portion of the bowl from the upper portion of the bowl in two or less turns.

* * * * *